US008032955B1

(12) United States Patent
Emerson

(10) Patent No.: US 8,032,955 B1
(45) Date of Patent: Oct. 11, 2011

(54) URINAL MODULE ADDED TO A TOILET

(75) Inventor: Dale H. Emerson, Cotati, CA (US)

(73) Assignee: Paul R. Emerson, Lodi, CA (US)

( * ) Notice: Subject to any disclaimer, the term of this patent is extended or adjusted under 35 U.S.C. 154(b) by 0 days.

(21) Appl. No.: 12/386,562

(22) Filed: Apr. 20, 2009

(51) Int. Cl.
*E03D 9/06* (2006.01)

(52) U.S. Cl. ..... 4/341

(58) Field of Classification Search ..... 4/340–342, 4/237

See application file for complete search history.

(56) References Cited

U.S. PATENT DOCUMENTS 3,822,419 A * 7/1974 Wilson, Sr. ..... 4/144.4
4,353,137 A * 10/1982 Jammet ..... 4/237
4,549,321 A * 10/1985 Douillard ..... 4/301
5,819,331 A * 10/1998 Miuccio ..... 4/341
6,671,891 B2 * 1/2004 Qi et al. ..... 4/340

* cited by examiner

*Primary Examiner* — Charles Phillips

(57) ABSTRACT

My invention is a new way to combine a urinal and a toilet. The urinal module changes the toilet's appearance very little.

The urinal module is simple to use and will help men keep their urine off the bathroom floor.

The module raises the toilet seat about three inches to help older people stand up after using the toilet.

The module slides off its rods so that it and the toilet bowl can be cleaned.

The urinal assembly is simple to install with two bolts holding it to the toilet bowl.

The module requires no extra space in the bathroom.

6 Claims, 3 Drawing Sheets

Urinal Module on Toilet
Open – Side View

Urinal Module on Toilet
Open – Side View

Urinal Module on Toilet
Open – Front View

Urinal Module on Toilet
Closed – Side View

Urinal Module
Side View

Urinal Module
Front View

Urinal Module
Top View - Cutaway

Cover
Side View

Cover
Front View

Cover
Bottom View

URINAL MODULE ADDED TO A TOILET

SUMMARY OF THE INVENTION

This invention is an oval-shaped module that is flat on the top and about three inches thick and is located between a toilet seat and a toilet bowl when is it not being used The urinal module housing is made by the plastic molding injection process making it water proof and water tight. There are two handles molded into the housing. The housing contains a funnel-shaped conduit that moves the urine into the toilet bowl.

The housing also contains two rod channels. These rod channels slide backward and forward on two rods that are hinged beside the toilet seat's hinges.

The rod hinges rotate on a shouldered bolt that is screwed into a threaded hole in the end of the mount.

These hinges also have a detent plate affixed to them so that they rotate together. The detent plate holds the urinal module at different angles to accommodate short or tall men.

There is a thumb screw affixed to one of the rod channels to hold the module stationary. There is also a releasable travel limiter on the other rod channel that stops the urinal at the ends of the rods or allows the module to be removed from the toilet.

There is a detent tube welded to the mount that contains the detent balls and springs.

The module has a molded inlet and a swinging tube outlet.

The toilet seat has a urinal inlet cover affixed to it that hides the inlet when the seat is lowered.

To use the urinal, a man grasps the handles on the sides of the module, raises it and pulls it to his desired position of use and tightens the thumb screw.

After use he loosens the thumb screw and slides the module back down to it's normal position on the toilet bowl.

DETAILED DESCRIPTION OF THE "URINAL MODULE ADDED TO A TOILET"

Figure 1:
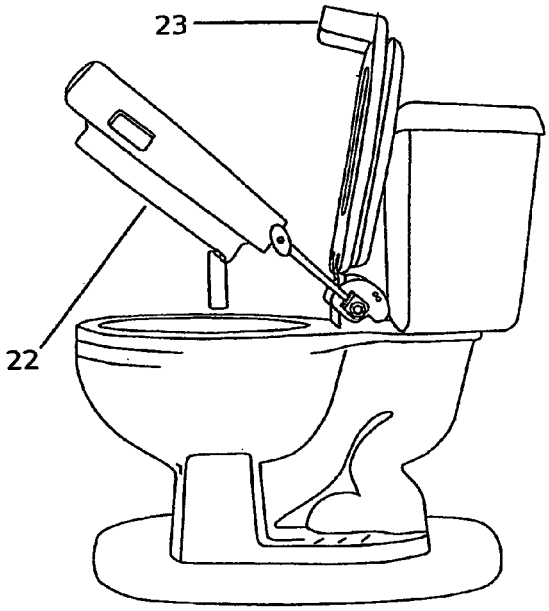
FIG. 1—Left side view showing the module attached to the toilet, partially extended.

FIG. 1 is the view from the left side and shows the module in a partially extended position. The detent balls and springs (12) hold the module horizontally and the thumb screw (13) holds the module in place vertically. Males of varying heights can move the module up or down, backward or forward on the rods (17) to adjust it to the most comfortable position.

Figure 2:
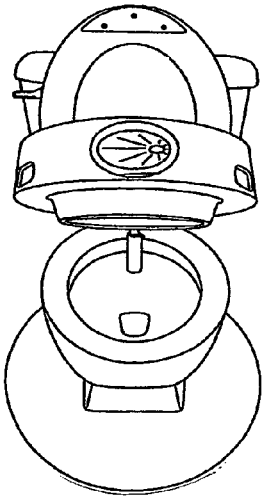
FIG. 2—Front view showing module in the same position (partially extended as in FIG. 1)

FIG. 2 is the partially extended frontal view as the man would see the module before using the handles (14) on each side to pull it toward himself. An important feature of this invention is that the urinal inlet (15) and swinging outlet (16) stay vertical inside the toilet bowl's front rim so that any drips will fall into the toilet bowl and not on the floor.

Figure 3:
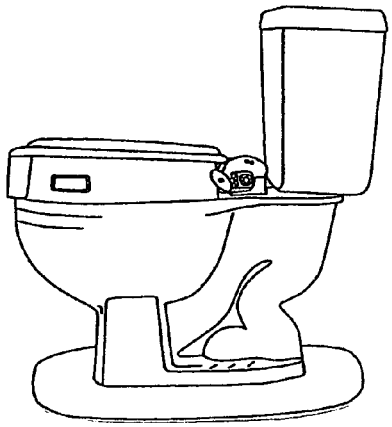
FIG. 3—View from the left side showing the module located on the toilet bowl, with toilet seat down in place when not in use FIG. 4—View from the left side showing the module, partially extended on a channel rod and the hinge with detent on the hinge mount FIG. 5—Front view of the module showing the handles on each side, the inlet and swinging tube outlet FIG. 6—View from the top, showing component parts within the module and attached to the module FIG. 7—Side view of the Inlet cover attached to the toilet seat FIG. 8—Front view of the inlet cover FIG. 9—Bottom view of the inlet cover showing mounting holes

FIG. 3 shows the appearance of the toilet when one enters the bathroom. The module is located between the toilet seat and the toilet bowl which raises the toilet seat about 3 inches. The toilet is ready for use by either females or males of the household. The urinal inlet is hidden from view by the cover (23) attached to the toilet seat.

By raising the toilet seat about 3 inches, the urinal module helps both older women and men get up to a standing position after using the toilet.

Figure 4:
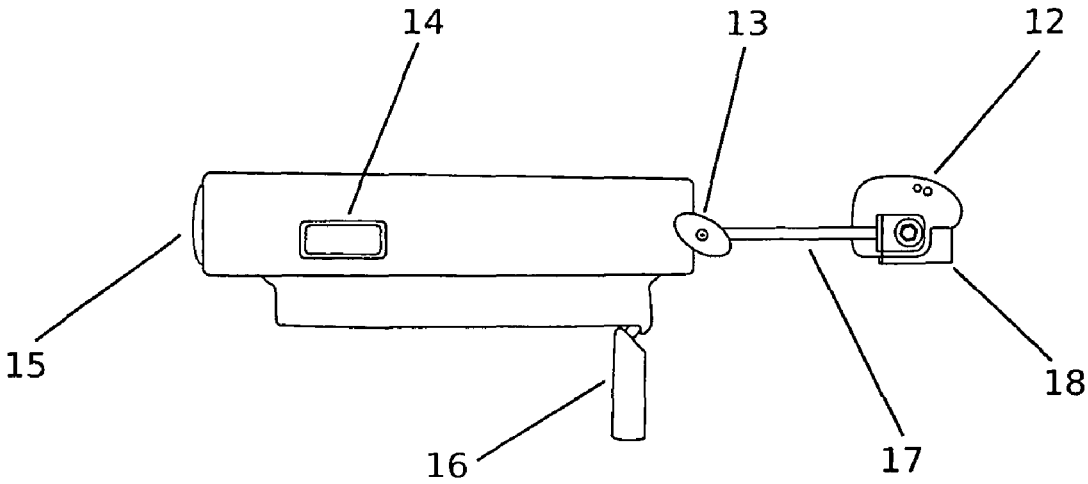

FIG. 4 shows the details of the module, including the hinge with detent (12) on the square tube hinge mount (18). The handles (14) on each side are used to slide the module back and forth on the rods (17) to adjust for the correct height of each male. The thumb screw (13) holds the module at the right level for use by males of varying heights. The inlet (15) and swinging tube outlet (16) are both in a vertical position inside the rim of the toilet bowl.

Figure 5:
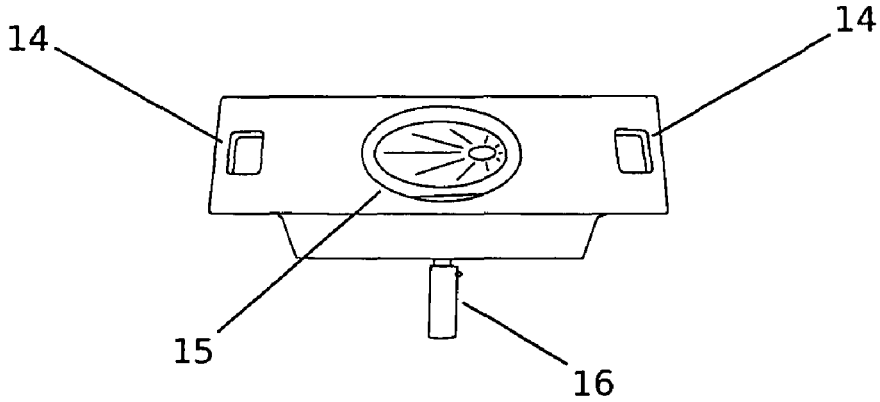

FIG. 5 provides greater detail of the handles (14) on each side of the module the inlet on the front (15) and the swinging tube outlet (16) which is close to the water level in the toilet.

Figure 6:
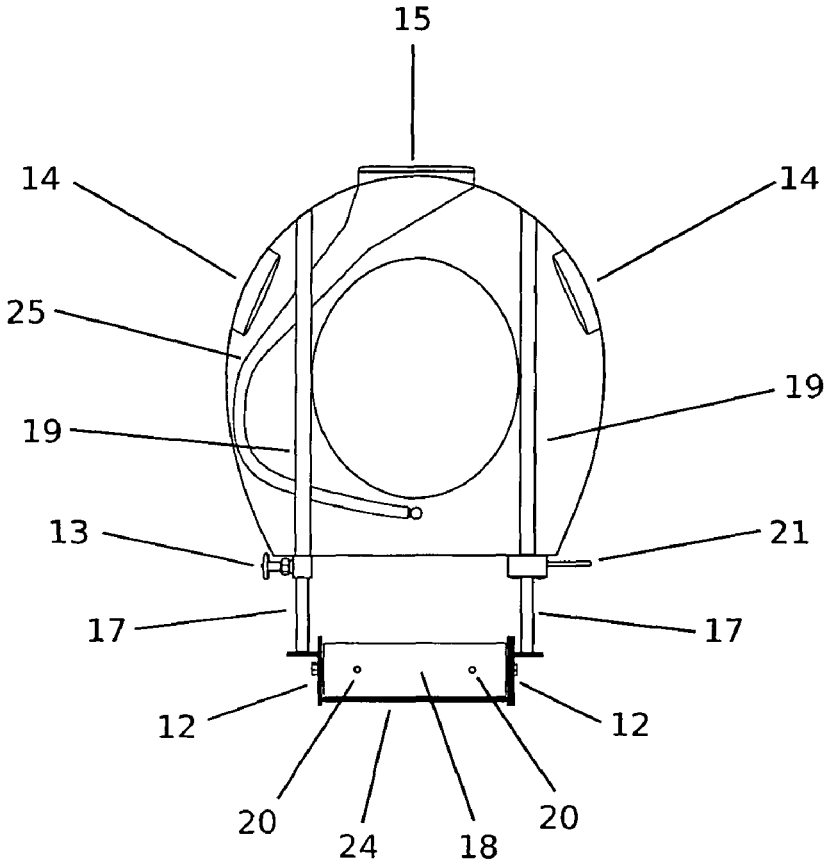

FIG. 6 is a top cutaway view showing the component parts within the module and the those attached to the module.

Component parts and details shown in FIG. 6, not described in previous figures, include the following: mounting holes (20), the releasable travel limiter (21) which keeps the module from sliding off the rods (17) inside the rod channels (19) . . . or allows the module to be taken off the rods for cleaning.

The detent tubes (24) contain springs and balls.

The urine conduit (25) allows the downward flow of urine from the inlet (15) to the swinging tube outlet (16).

Figure 7:
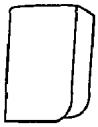

FIG. 7 is a side view of the cover (23) which hides the inlet on the front of the module when the toilet seat is lowered.

Figure 8:
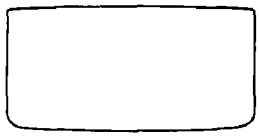

FIG. 8 is a front view of the cover (23) attached to the toilet seat to hide the inlet when the seat is down.

Figure 9:
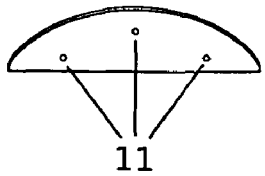

FIG. 9 is a bottom view of the cover (23) showing the 3 holes (11) where the cover is screwed to the toilet seat.

| Reference Designator | Description |
|---|---|
| 11 | Cover Mounting Holes |
| 12 | Hinge with detents |
| 13 | Thumb screw |
| 14 | Handle |
| 15 | Inlet |
| 16 | Outlet |
| 17 | Rod |
| 18 | Square Tube Hinge Mount |
| 19 | Rod Channel |
| 20 | Mounting Hole |
| 21 | Releasable Travel limiter |
| 22 | Urinal Module |
| 23 | Cover |
| 24 | Detent Tube |
| 25 | Urine Conduit |

The invention claimed is:

1. A urinal for attachment to toilet bowl between a toilet seat and a toilet bowl for aiding a male user in a urination process from a standing position in front of a toilet bowl, comprising;

a module, in the general shape of a toilet seat, having a funnel shaped inlet in the front thereof in order to accept a stream of urine from a male user, at least one handle on a side of said module and a urine conduit connected to said inlet and leading to an outlet so as direct urine from said inlet to a toilet bowl, a pair of rod channels located in said module, a hinge mount adapted to be attached to a rear portion of a toilet bowl, said hinge mount including a pair of rods attached thereto and extending from the back of the bowl toward the front of the bowl, said rods being mounted on said hinge mount so as to be pivotal from a horizontal position to various positions between horizontal and vertical, said rods being slideably engaged in said pair of rod channels such that the user by grasping said at least one handle can slide said module along said pair of rods and pivot said module to a desired orientation between horizontal and vertical.

2. The urinal of claim 1 wherein said at least one handle comprises two handles, one located on each side of said module.

3. The urinal of claim 1 further comprising a thumb screw for holding a desired adjusted position of said rods in said rod channels.

4. The urinal of claim 1 further comprising a releasable travel limiter to prevent disengagement of said rods from said channels.

5. The urinal of claim 1 wherein said outlet comprises a swinging outlet so as to assume a vertical disposition in a toilet bowl when said module is in use.

6. The urinal of claim 1 further comprising a cover for attachment to a toilet seat in order to conceal said inlet when a toilet seat is disposed on said module.

* * * * *